United States Patent [19]

Dinh

[11] Patent Number: 4,607,498

[45] Date of Patent: Aug. 26, 1986

[54] HIGH EFFICIENCY AIR-CONDITIONER/DEHUMIDIFIER

[75] Inventor: Khanh Dinh, Gainesville, Fla.

[73] Assignee: Dinh Company, Inc., Alachua, Fla.

[21] Appl. No.: 614,025

[22] Filed: May 25, 1984

[51] Int. Cl.[4] ..... F25D 17/02; F28D 15/00

[52] U.S. Cl. ..... 62/185; 62/333; 62/90; 165/104.21

[58] Field of Search ..... 62/90, 176.5, 173, 333, 62/119, 185; 165/104.21

[56] References Cited

U.S. PATENT DOCUMENTS 2,093,725 9/1937 Hull ..... 62/333 X
2,905,851 9/1959 Caussin ..... 165/104.21 X

OTHER PUBLICATIONS

"Gainesville Researcher Enhances Air Conditioning" (Aug. 10, 1983).
"New Air-Conditioner Unit Can Dry Air, Save Money" (St. Petersburg Times, Aug. 1983).
"Fsec Activities" (The Solar Collector", Oct. 1982).
"Q-Pipe Modular Thermal Recovery Unit".
"Unique A.C. Unit Cools It, Dries It Up" (The Solar Collector, Jul. 1983).
Handbook of Air Conditioning, Strock, 1959 TH 7687 S76 G3, pp. 1-113 & 114.
Engineering Thermodynamics, Stoever, 1951, John Wiley & Sons.

*Primary Examiner*—William E. Wayner
*Attorney, Agent, or Firm*—Schwartz, Jeffery, Schwaab, Mack, Blumenthal & Evans

[57] ABSTRACT

The system in the present invention includes HVAC unit, such as an air-conditioner, having an evaporator coil, and a heat exchanger for drawing heat from air entering the inlet side of the air-conditioner evaporator and supplying heat to air at the outlet side of the air-conditioner evaporator. The heat exchanger is a phase change heat pipe-type heat exchanger, having a evaporator before the air-conditioning evaporator and a condenser after the air-conditioner evaporator.

5 Claims, 5 Drawing Figures

HIGH EFFICIENCY AIR-CONDITIONER/DEHUMIDIFIER

BACKGROUND OF THE INVENTION

The present invention relates to systems for increasing the dehumidifying effect of air-conditioners, and especially two such systems which are capable of operating at extremely high efficiencies.

It is well known that high humidity, as well as high temperatures, create uncomfortable living conditions. Great progress has been made in air-conditioning technology to lower air temperature in a given environment. However, high humidity remains a problem to be overcome.

It is also well known that reducing the temperature of air also reduces the humidity in the air. Accordingly, in the attempt to draw out moisture-ladened air, air-conditioners have been run excessively, thus overcooling the environment, while reducing the humidity to a still insufficient level. The result is cool, but clammy air, achieved at a loss of efficiency because the air-conditioning unit is run excessively. The current practice called Reheat uses an auxillary source of energy to reheat the cold air, at great expenses of energy.

Systems have been suggested to increase the dehumidifying effect of an air-conditioner without Reheat. For example, a system developed at Trinity University in San Antonio, Tex. incorporates an air-to-air plate heat exchanger attached to the air-conditioner inlet and outlet. Cold air leaving the air-conditioner is used to pre-cool incoming air. The Georgia Institute of Technology has a similar system using a run-around loop where a fluid is pumped through two liquid-to-air coils to achieve a heat transfer effect as above.

SUMMARY OF THE INVENTION

An object of the present invention is to provide an air-conditioning system having an improved dehumidifying characteristic.

Another object of the present invention is to provide an improved air-conditioning and dehumidifying system, which is extremely efficient in use and requires only a minimum of components, in addition to a conventional air-conditioner.

A further object of the present invention is to provide a system which can be used as a heat pump to provide either cooling or heating of interior air and in which changeover from cooling to heating disables the dehumidifying feature of the system.

Yet another object of the present invention is to provide an air-conditioning and dehumidifying system which can be operated to produce domestic hot water as a by-product.

In accordance with the above and other objects, the present invention is an air-conditioning and dehumidifying system comprising an air-conditioning unit, having a housing with an air inlet and an air outlet, an air passage extending from the inlet to the outlet, and an evaporator unit disposed in the air passage. The air-conditioning unit also has a blower for forcing air through the evaporator from the inlet side of the air passage to the outlet side of the air passage. The system also includes a phase-change heat exchanger, which comprises an evaporator section disposed on the inlet side of the air passage and a condenser section disposed on the outlet side of the air passage. The evaporator has a liquid refrigerant inlet and a vapor outlet. The condenser has a vapor inlet and a liquid refrigerant outlet. The vapor inlet is at a higher level than the liquid refrigerant outlet so that liquid refrigerant can freely flow out of the condensor into the liquid refrigerant inlet of the condenser. The vapor inlet of the condensor section is connected to the vapor outlet of the evaporator. A refrigerant is disposed in the heat exchanger in such quantity that the refrigerant draws heat from air moving through the inlet side of the air passage and vaporizes in the evaporator, the vaporized refrigerant flows to the condenser and gives up heat to the air passing through the outlet side of the air passage, thus condensing. The condensed refrigerant then flows to the evaporator.

In accordance with other objects of the invention, the condenser of the heat exchanger may be disposed at a higher level than its evaporator, so that the flow of fluid from the liquid refrigerant outlet to the liquid refrigerant inlet takes place under the influence of gravity. In this case, no pump or other power source is required to operate the heat exchanger.

In accordance with other aspects of the invention, the heat exchanger may comprise a plurality of evaporators connected, respectively, to a plurality of condensers to form a plurality of heat exchanger units. The greater the number of heat exchanger units, the greater the effectiveness of the heat-exchanger.

As a further aspect, the system can be used as a heat pump, having either a cooling cycle or a heating cycle. The function of the air-conditioner evaporator and a condenser are reversed from the cooling cycle to the heating cycle. If the heat exchanger is used in a gravity flow mode, the dehumidifying function will be automatically disabled during the heating cycle of the heat pump.

BRIEF DESCRIPTION OF THE DRAWINGS

The above and further objects of the present invention will become more readily apparent as the invention is more clearly understood from the detailed description to follow, reference being had to the accompanying drawings in which like reference numerals represent like parts throughout, and in which.

DETAILED DESCRIPTION OF THE PREFERRED EMBODIMENT

Figure 1:
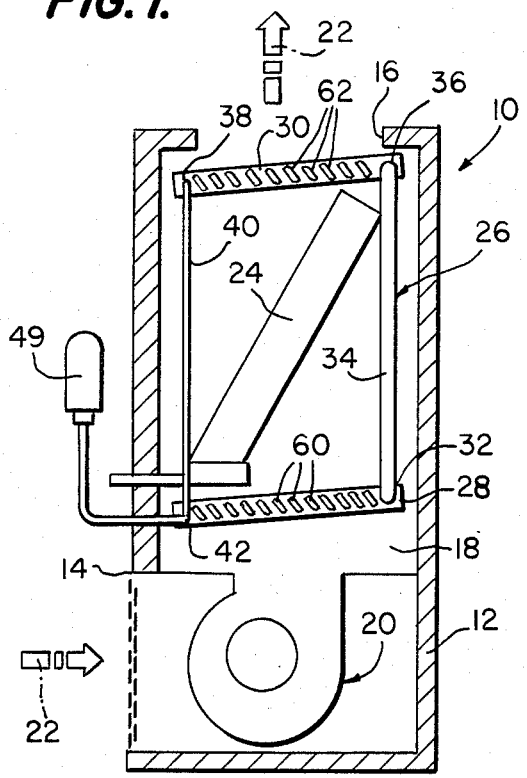
FIG. 1 is an elevational schematic view showing one embodiment of the present invention.

FIG. 1 shows a portion of a heat pump and dehumidifier system 10, which comprises a housing 12, having an inlet 14 and an outlet 16. An air passage 18 extends from the inlet 14 to the outlet 16 and a blower 20 is disposed in air passage 18 to produce an air flow through housing 20. The direction of the air flow is indicated by arrows 22. A coil 24 is disposed across the air passage 18. Coil 24 can either be an evaporator or a condenser coil, depending on whether the unit 10 is connected for cooling or heating purposes. A reservoir is connected to the refrigerant circuit and is located out of the air stream to receive and condense refrigerant so as to limit the pressure inside the heat exchanger to safe levels in case of overheating from heating operation.

A heat pipe heat exchanger 26 is disposed in air passage 18. Heat exchanger 26 comprises a heat exchanger evaporator 28 which is disposed on the inlet side of air passage 18 relative to coil 24, and a heat exchanger condenser coil 30, which is disposed on the outlet side of air passage 18 relative to coil 24. Evaporator 28 has a vapor outlet 32, which is connected through tubing 34 to a vapor inlet 36 of condenser coil 30. Condenser coil 30 has a liquid refrigerant outlet 38, which is connected through tubing 40 to a liquid refrigerant inlet 42 of evaporator 28. The heat exchanger 26 contains a refrigerant, such as Freon.

A pressure limiting safety reservoir 49 is connected to the heat pipe heat exchanger 26 to provide an expansion area for the refrigerant in the heat exchanger. Reservoir 49 is located out of the air stream created by housing 20.

Figure 3:
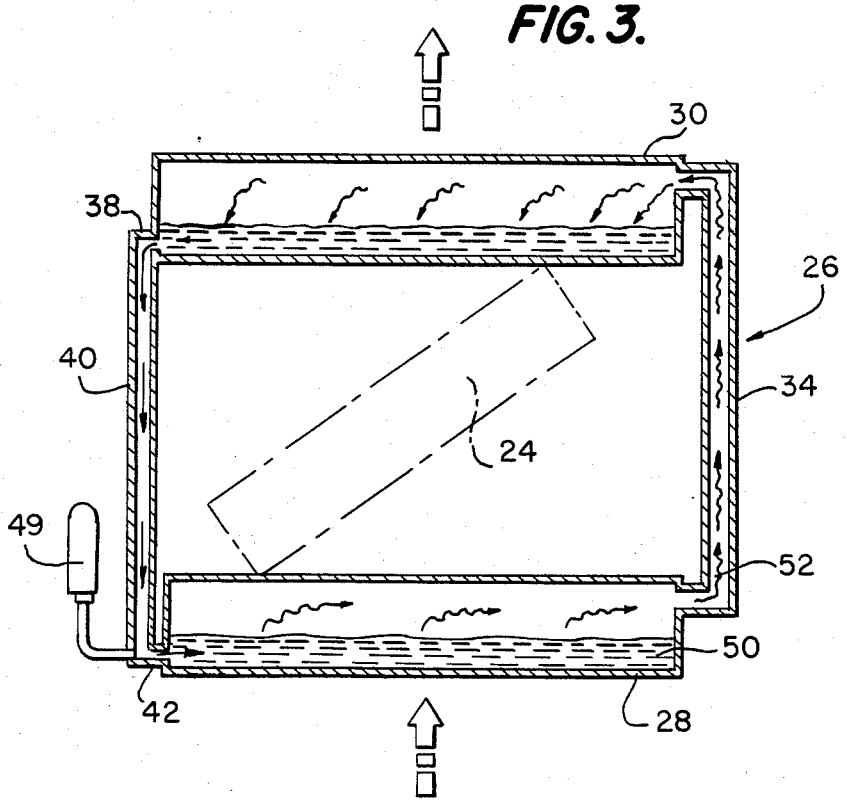
FIG. 3 is a schematic view depicting the operation of the gravity flow heat pipe heat exchanger of the present invention.

With reference to FIG. 3, the operation of the heat pipe heat exchanger 26 will be discussed. Liquid refrigerant 50 disposed in evaporator 28 absorbs heat from air flowing over the evaporator and vaporizes. The vaporized refrigerant 52 rises within evaporator 28 and exits into tube 34. The vaporized refrigerant rises through tube 34 and enters condenser 30 through the vapor inlet. The air passing over evaporator 28 is cooled in this manner and then enters coil 24 which, in this case, acts as an air-conditioner evaporator. Accordingly, coil 24 removes additional heat from the air, which then passes over condenser 30. The cooled air removes heat from the vaporized refrigerant 52 in condenser 30, causing the refrigerant to return to the liquid state. The liquid refrigerant then flows out of outlet 38, through pipe 40, and into the liquid refrigerant inlet 42 of evaporator 28. This cycle continues to repeat itself as long as condenser 30 is disposed above the level of evaporator 28, so that the liquid refrigerant can flow through tube 40 under gravity, and the vaporized refrigerant can rise naturally in tube 34.

It should be noted that, if the operation of unit 10 is reversed so that coil 24 acts as a condenser, the air flowing into evaporator 28 will be cooler than the air flowing out of condenser 30. Accordingly, the vaporization condensation cycle of heat pipe heat exchanger 26 will not occur, and heat exchanger 26 will not affect the temperature of the air. This result is useful in connection with a heat pump, since the dehumidifying operation of heat exchanger 26 is desirable during the cooling cycle, but not during the heating cycle.

From the foregoing explanation, it is clear that the function of heat exchanger 26 is to initially reduce the temperature of air during a cooling cycle. Specifically, if the air flow into evaporator 28 is approximately 80°, the air flow out of evaporator 28 would be approximately 65°. Evaporator coil 24 would reduce the air temperature to approximately 50°, at which temperature, approximately 50% more water would be removed from the air than with the coil acting alone. The temperature of the dehumidified air is then raised to a comfortable level of approximately 70° as it passes through heat exchanger condenser coil 30. Further, heat exchanger 26 operates in a passive mode, without any active component being required. Since the heat exchanger provides about 50% free cooling of the incoming air, the air flow can be increased by approximately 50% to keep the evaporation temperature at a normal 40° to 45°. As a result of these working conditions, the machine 10 can have a dehumifidying capacity twice that of a standard air-conditioner of the same tonage, and the ratio of latent heat over total heat removal is approximately 60% to 70%, compared to a typical 30% for a normal air-conditioner.

Referring again to FIG. 1, it will be noted that both the evaporator 28 and condenser 30 can be made with a plurality of coils 60, 62, respectively in order to enhance the evaporation and condensation functions. The coils 60 can be connected in parallel to one another, as can be coils 62. Common headers can be connected at opposite ends of the coils. The inlets and outlets to the evaporator 32 and condenser 30 would be connected to the headers at one end at the back of each coil. It should also be noted that in each case, the liquid port should be disposed below the level of the vapor port, that is, liquid inlet 42 must be disposed below the level of vapor outlet 32 and liquid outlet 38 must be disposed below the level of vapor inlet 36 to ensure proper, efficient operation.

In order the reduce manufacturing costs, the heat pipe heat exchanger 26 can be formed of conventional air-conditioner evaporators, with one conventional air-conditioner evaporator being used as evaporator 28 and a second conventional air-conditioner evaporator being used as condenser 30. Standard air-conditioning tubing can be used as tubing 34 and 40.

Figure 2:
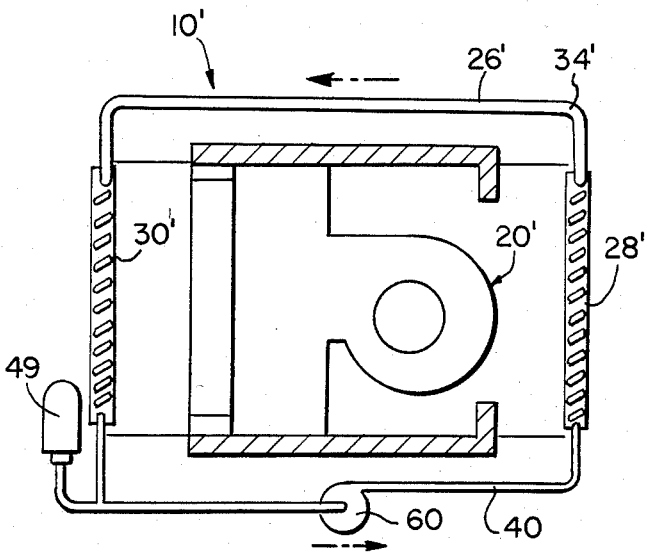
FIG. 2 is an elevational schematic view showing a second embodiment of the present invention.

FIG. 2 shows a modification of the system of the present invention for use in extremely large installations or in situations where it is impractical to dispose the heat exchanger evaporator coil below the condenser coil. System 10', shown in FIG. 2, includes an evaporator coil 28', which is at the same level as condenser coil 30'. In this case, a pump 60 must be disposed in the liquid flow line 40' to ensure proper flow of the liquid refrigerant from condenser 30' to evaporator 28'. Other than for the addition of pump 60, system 10' is essentially the same as system 10, elements having corresponding functions in system 10' are denoted by the same reference numeral as in system 10, with the addition of a "'".

Figure 4:
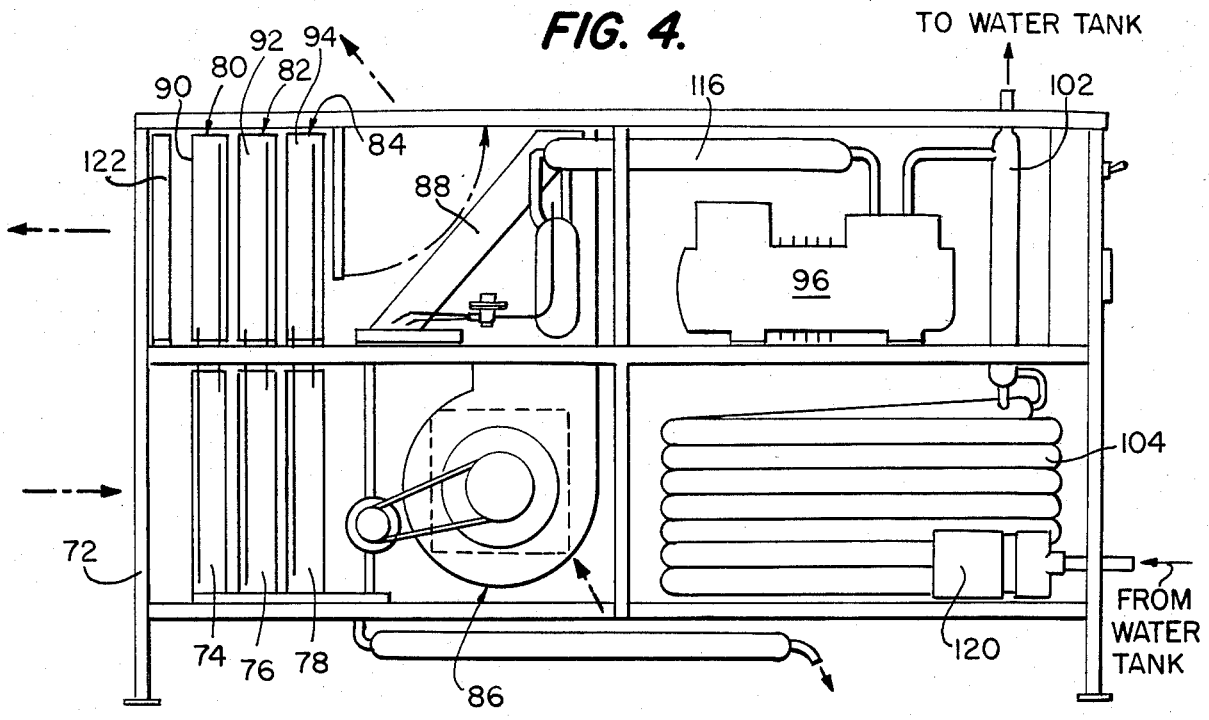
FIG. 4 is an elevational view showing a layout of a system incorporating the present invention and using waste heat to produce domestic hot water.
Figure 5:
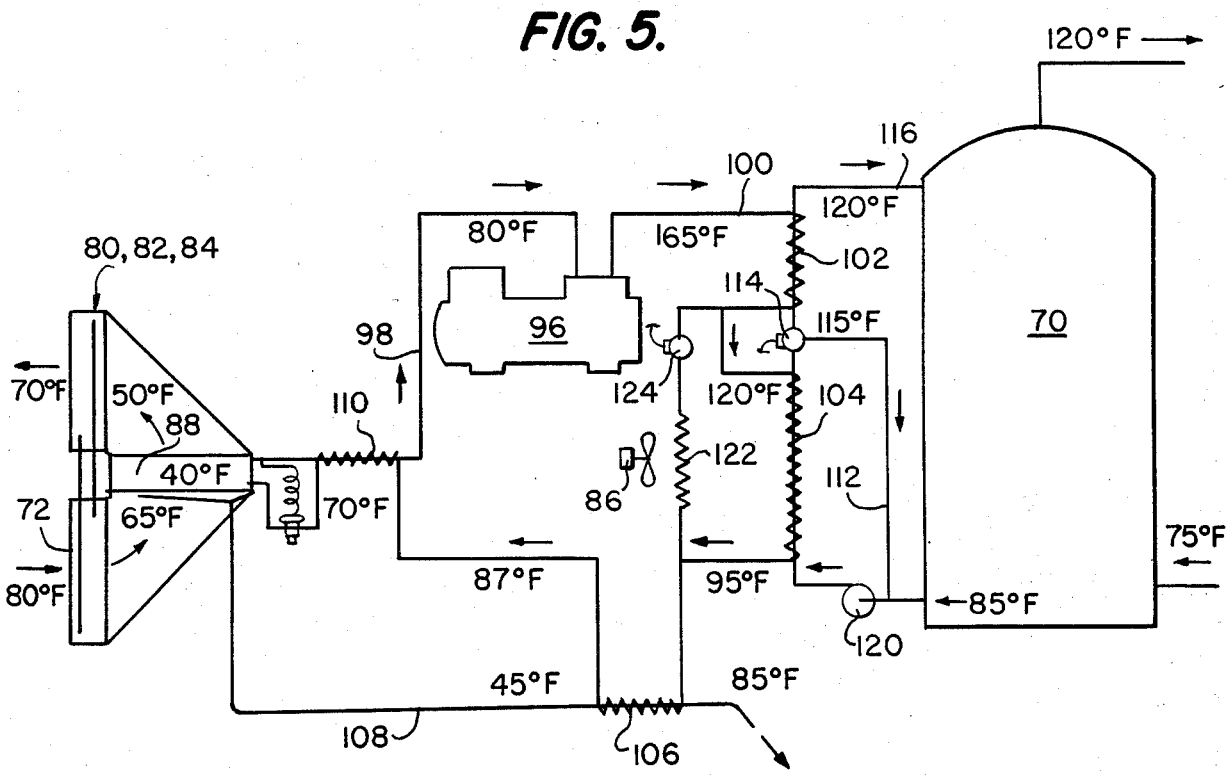
FIG. 5 is a schematic view showing the operation of the device at FIG. 4.

FIGS. 4 and 5 show an air-conditioning/dehumidifing system according to the present invention, connected so that waste heat from the system is used to increase the temperature of domestic hot water in a domestic hot water tank 70.

As shown in FIGS. 4 and 5, the air inlet 72 to the system receives air at approximately 80°. This air is channeled through the evaporators 74, 76, and 78 of three heat pipe heat exchanger units 80, 82, and 84, respectively. The incoming air is cooled to approximately 65° by evaporators 74, 76, and 78. The air is drawn through the system by a blower 86, which forces the air through an evaporator 88 of the air-conditioning unit and out through condensers 90, 92, and 94 of the heat exchangers 80, 82, and 84, respectively.

The heat exchangers are designed with finned coils with an oversized face area to minimize air flow resistance. Three independent heat exchangers 80, 82, and 84 are used and work at different temperatures to provide a semi-counter flow effect. The blower 86 runs at an unusually low RPM to consume a minimum amount of power.

The air is cooled to approximately 50° by evaporator 88 and is then raised to a final temperature of approximately 70° by passing through condensers 90, 92, and 94. It will be noted that the air passing out of the system passes through heat exchanger 84, then heat exchanger 82, and then heat exchanger 80 in the opposite order to the incoming air, which passes through heat exchanger 80 first.

Refrigerant is circulated through evaporator 88 by compressor 96. Compressor 96 draws refrigerant through suction line 98 from the evaporator 88, compresses the refrigerant and forces it through line 100. Line 100 passes through a desuperheater 102, which transfers heat to water from tank 70, a Freon-to-water condenser 104, which also transfers heat to water tank 70, a liquid Freon-to-condensate heat exchanger 106, which transfers heat to liquid condensate removed through line 108, and an interchanger 110, which transfers heat to the fluid in suction line 98. The interchanger 110 is designed to cool the liquid Freon as close to the evaporation temperature as possible. This is also a safety feature to prevent sludging of the compressor.

A high velocity runaround loop 112 is used on the Freon-to-water condenser 104 to ensure efficient heat transfer. A thermostatic valve 114 controls runaround loop 112 so that water heated below approximately 115° is recirculated through heat exchanger 104 and water heated above 115° passes through a line 116 into tank 70. A low capacity pump 120 is provided to circulate the water from tank 170.

Since there is no provision for disharging heat to the outdoors, an emergency condenser 122, acting as a reheat coil, is added to the discharge air from the heat pipe so that Freon can be condensed, even when the storage water is too hot to provide total condensation. The air is circulated through the reheat coil 122 by blower 86. The reheat coil is not used under normal conditions. A thermostatic valve 124 controls the flow of Freon through the reheat coil 122.

For a typical well built house of approximately 1500 square feet, the machine shown in FIGS. 4 and 5 produces good results using approximately a one horsepower compressor with a one-quarter horsepower blower 86. The blower capacity in free air should be approximately 600 cubic feet per minute, at approximately 550 RPM. A one thirty-fifths horsepower pump 120 can be used to circulate the water from tank 70. The system can produce a cooling capacity of 12,000 to 14,000 BTU/h with a moisture removal capacity of seven to eight pounds per hour. Twelve hundred to fourteen hundred watts of power are used from a two hundred and thirty volt AC source at 60 Hz. The machine can produce thirty-five gallons per hour, approximately, of hot water, with a hot water temperature of 100° to 120° F. The estimated coefficiency of performance (COP) is approximately three. The pump 120 is designed to produce a high velocity flow through the runaround loop 112. A flow rate of approximately four gallons per minute is desirable to produce high efficiency heat exchange and also to prevent scaling. A high efficiency, close tolerance refrigeration motor compressor (semi-hermetic type) is used rather than a regular AC compressor.

Both the blower 86 and the compressor 96 have controlled power supplies to ensure maximum efficiencies. If desired, these components can be operated with DC motors driven from a photovoltaic array.

With relatively minor modifications, the machine can be made into a reverse cycle heat pump. In this case, the gravity heat exchangers 80, 82, and 84 will act as thermal diodes and will not transfer heat from the supply to the return air stream, ensuring a maximum efficiency to the heating function.

The foregoing description is set forth for purposes of illustrating the invention, but is not meant to be limitative thereof. Clearly, numerous substitutions, additions and other modifications can be made to the invention without departing from the scope thereof, as set forth in the appended claims.

What is claimed:

1. A system for controlling air temperature and humidity, comprising:

an air temperature controlling unit comprising a heat pump having a heat mode and a cooling mode, said heat pump having a housing with an air inlet and an air outlet, an air passage extending from said inlet to said air outlet, a refrigerant coil disposed in said air passage, and a blower for forcing air through said refrigerant coil from said inlet to said outlet;

a phase-change heat exchanger comprising heat pipes and including an evaporator section disposed on an inlet side of said passage, a condenser section disposed on an outlet side of said air passage, said evaporator section having a liquid refrigerant inlet and a vapor outlet, said condenser section having a vapor inlet and a liquid refrigerant outlet, said vapor inlet being at a higher level than said liquid refrigerant outlet, said liquid refrigerant inlet being connected to said liquid refrigerant outlet, and said vapor inlet being connected to said vapor outlet, and a refrigerant disposed in said heat exchanger in such quantity that said refrigerant vaporizes in said evaporator section to draw heat from air moving through said inlet side of said air passage when said heat pump is in said cooling mode, vaporized refrigerant flows to said condenser section and condenses in said condenser section to transfer heat to air passing through said outlet side of said air passage, and liquid refrigerant flows to said evaporator from said condenser, and whereby when said heat pump is in said heat mode said phase change heat exchanger acts as a thermal diode and is rendered inoperative; and a liquid refrigerant reservoir located outside of the air stream and which has sufficient capacity to contain the liquid refrigerant and limit the pressure within the heat exchanger when the heat exchanger is subjected to high temperatures from the heating apparatus.

2. A system as set forth in claim 1, wherein said heat exchanger comprises a plurality of evaporators connected, respectively, to a plurality of condensers to form a plurality of heat exchanger units.

3. A system as set forth in claim 1, wherein said evaporator comprises a plurality of heat exchange tubes connected in parallel.

4. A system for controlling air temperature and humidity, comprising:

an air temperature controlling unit, having a housing with an air inlet and an air outlet, an air passage extending from said inlet to said air outlet, a refrigerant coil disposed in said air passage, and a blower for forcing air through said refrigerant coil from said inlet to said out;

a phase-change heat exchanger comprising an evaporator section disposed on an inlet side of said passage, a condenser section disposed on an outlet side of said air passage, said evaporator section having a liquid refrigerant inlet and a vapor outlet, said condenser section having a vapor inlet and a liquid refrigerant outlet, said vapor inlet being at a higher level than said liquid refrigerant outlet, said liquid refrigerant inlet being connected to said liquid refrigerant outlet, and said vapor inlet being connected to said vapor outlet, and a refrigerant disposed in said heat exchanger in such quantity that said refrigerant vaporizes in said evaporator section to draw heat from air moving through said inlet side of air passage, vaporized refrigerant flows to said condenser section and condenses in said condenser section to transfer heat to air passing through said outlet side of said air passage, and liquid refrigerant flows to said evaporator from said condenser;

a compressor connected to said refrigerant coil, a refrigerant-water heat exchanger connected to said compressor, and a water tank connected to said refrigerant-water heat exchanger, and a high velocity run-around loop connected to said refrigerant-water heat exchanger for continuously circulating water through said refrigerant-water heat exchanger when said water is below a predetermined temperature.

5. A system as set forth in claim 4, wherein said run-around loop includes a thermostatically controlled valve.

* * * * *